US008556446B2

(12) United States Patent
Campman

(10) Patent No.: US 8,556,446 B2
(45) Date of Patent: Oct. 15, 2013

(54) ATTENTION GETTING BATON WITH A FLASHLIGHT

(75) Inventor: James P. Campman, Transfer, PA (US)

(73) Assignee: Grace Industries, Inc., Fredonia, PA (US)

( * ) Notice: Subject to any disclaimer, the term of this patent is extended or adjusted under 35 U.S.C. 154(b) by 227 days.

(21) Appl. No.: 13/137,488

(22) Filed: Aug. 22, 2011

(65) Prior Publication Data

US 2013/0050993 A1 Feb. 28, 2013

(51) Int. Cl.

| | |
|---|---|
| ***A45B 3/02*** | (2006.01) |
| ***A63B 15/02*** | (2006.01) |
| ***F21V 33/00*** | (2006.01) |
| ***B25B 23/18*** | (2006.01) |

(52) U.S. Cl.
USPC ..... 362/102; 362/109; 362/120

(58) Field of Classification Search
USPC ..... 362/102, 109, 120
See application file for complete search history.

(56) References Cited

U.S. PATENT DOCUMENTS

| | | | | |
|---|---|---|---|---|
| 2,486,998 | A * | 11/1949 | Szeklinski | 340/321 |
| 5,060,123 | A * | 10/1991 | Arnold | 362/102 |
| 5,893,629 | A * | 4/1999 | Gubernick | 362/186 |
| 6,213,623 | B1 * | 4/2001 | Campman | 362/202 |
| 6,293,684 | B1 * | 9/2001 | Riblett | 362/184 |
| 7,261,456 | B2 * | 8/2007 | Liu | 362/577 |
| 7,661,594 | B2 * | 2/2010 | Kennedy et al. | 235/462.22 |

* cited by examiner

*Primary Examiner* — David J Makiya
(74) *Attorney, Agent, or Firm* — Daniel K. Dorsey

(57) ABSTRACT

An attention getting baton with a one-piece hollow tubular structure that is waterproof, shock resistant, and lightweight. At a rear tubular part, there is a holding compartment with a ribbed rubber grip for ease in handling the baton. A front tubular part with ribbed groves guides illumination through the baton. A tubular shaped removable rear cap forms a slip fit connection for accessibility into the holding compartment. A high intensity flashlight, inserted into the holding compartment, communicates a high intensity light beam through the baton. When pushed, a button, mounted to the rear cap, switches the flashlight into a plurality of modes such as an on/off mode, a strobe mode, and a mode to generate help or an SOS signal. Thus, the baton has applicability to fire scenes, traffic and crowd control, police operations, military procedures, search and rescue operations, event parking, or just personal use.

15 Claims, 3 Drawing Sheets

ATTENTION GETTING BATON WITH A FLASHLIGHT

BACKGROUND OF THE INVENTION

Field of the Invention

The present invention relates to a hand held baton with a flashlight mounted therein for the field of light communications and more particularly to a traffic control type baton with a high intensity flashlight mounted therein to provide strobe, flashing, and a high intensity beam capability.

CROSS-REFERENCE TO RELATED PATENTS

U.S. Pat. No. 5,865,524, entitled HAND HELD LIGHT WAND FOR VISUAL SIGNALING, to Campman is a resilient and watertight visual signaling light emitting wand that provides a user with a choice of multiple colors by simply turning a ring switch.

U.S. Pat. No. 6,213,623 B1, entitled GLOW AND FLASH BATON, to Campman is a resilient watertight light baton with exterior walls machined to effectively transmit light from an embedded light source, which is easily controlled with one button.

U.S. Pat. No. 6,371,625 B2, entitled ALL SOLID-STATE OMNI DIRECTIONAL LUMINARY AND FLASHLIGHT, to Campman is a hand held laser lens glow and visually signaling baton.

These inventions are hereinafter incorporated by reference therein.

SUMMARY OF THE INVENTION

Accordingly, it is an object of the invention to provide an attention getting baton having a hollow tubular structure for communicating illumination through the baton.

Another object of the invention is to provide a rear tubular part for the hollow tubular structure that defines a holding compartment and a handle member for the hollow tubular structure of the baton.

A further object of the invention is to provide a ribbed rubber grip for wrapping around the rear tubular part and nearly covering the rear tubular part for easy handling of the baton when illumination being communicated through the hollow structure.

A still further object of the invention is to provide a front tubular part being exposed and formed of industrial grade plastic with ribbed groves for guiding illumination communicated from the rear tubular part.

An object of the invention is to provide a stationary ring stop positioned between the rear tubular part and the front tubular part in the hollow tubular structure for further defining the holding compartment by providing a stopping function from the rear tubular part to the front tubular part of the hollow tubular structure.

Another object of the invention is to provide a tubular shaped removable rear cap having a diameter slightly larger than the rear tubular part for forming a slip fit type connection and abutting the ribbed rubber grip when positioned snuggly around the rear tubular part and for providing an easily accessible rear access into the holding compartment of the hollow tubular structure.

It is an object of the invention is to provide a button mounted to the tubular shaped removable rear cap, wherein the button being aligned on a center axis of the hollow tubular structure for switching the baton into a plurality of modes with the plurality of modes being an on/off mode, a strobe mode, and a mode to generate help or an SOS signal.

Another object of the invention is to provide a removable tubular shaped front cap having a diameter slightly larger than the front tubular part and being made of a pliable clear plastic vinyl material for illuminating light communicated from the rear tubular part through the front tubular part of the hollow tubular structure, and for snugly and securely forming a slip tight fitting with the front tubular part of the hollow tubular structure so as to be positioned away from the rear removable rear cap with the stationary ring stop positioned in between in the hollow tubular structure.

A further object of the invention is to provide a high intensity flashlight being inserted into the holding compartment of the rear tubular part of the hollow tubular structure for communicating a high intensity light beam illuminated through front tubular part and the clear flexible vinyl plastic top cap.

It is an object of the invention wherein the hollow tubular structure being made of industrial grade plastic vinyl and being waterproof, highly shock resistant, and extremely lightweight.

It is an object of the invention wherein the button being a push button for controlling the high intensity flashlight.

A still further object of the invention wherein the flashlight providing covert signaling by using an infrared light source.

It is an object of the invention wherein the flashlight providing covert signaling by using an ultraviolet light source.

It is an object of the invention wherein the flashlight being removable through the easily accessible rear access of the holding compartment in the hollow tubular structure.

It is an object of the invention wherein the flashlight as a light source being interchangeable with other light sources.

It is an object of the invention wherein the hollow tubular structure being interchangeability with other sizes and colors of hollow tubular structures for producing different color light sources.

It is an object of the invention wherein the flashlight being inserted into the rear tubular part and the stationary ring stops abruptly stopping the flashlight from moving forward into the front tubular part.

It is an object of the invention wherein a piece of foam being inserted between the button and the flashlight so as to be in physical communication with the flashlight.

It is an object of the invention wherein the foam moving forward with the press of the button for providing control of the flashlight.

It is an object of the invention wherein a first press of the button places the flashlight in an on mode.

It is an object of the invention wherein a second press of the button places the flashlight in a strobe mode.

It is an object of the invention wherein a third press of the button places the flashlight in a help mode.

It is an object of the invention wherein a fourth or final press of the button places the flashlight in an off mode.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Preferred structural embodiments and preferred subcomponents of this invention are disclosed in the accompanying drawings in which.

DESCRIPTION OF THE INVENTION

Figure 1:
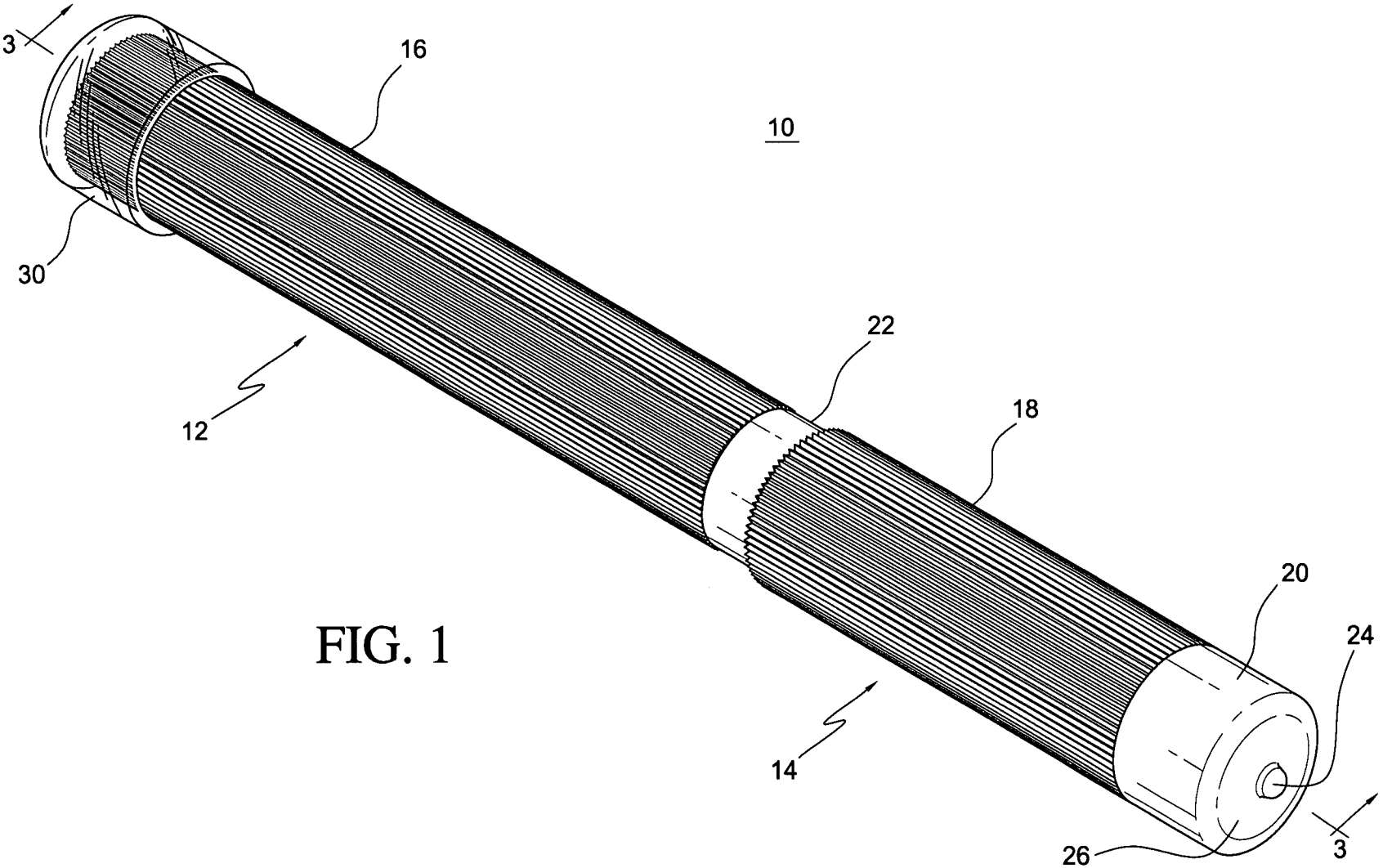
FIG. 1 illustrates a perspective view of an embodiment of an attention getting baton with a flashlight, in accordance with the present invention.

With reference to FIG. 1, the figure depicts a perspective view of the attention getting baton, generally indicated as 10. As shown in FIG. 1, the baton 10 is easily utilized and can be used as a hand held baton. The baton 10 is formed with a hollow tubular structure 12. The hollow tubular structure 12 is a one piece about twelve inches long and has a diameter of one and a five-eighths inches in diameter in the preferred embodiment. Of course, other lengths for the baton 10 have and are contemplated, because the baton 10 is interchangeable with tubular housings lengths of twelve inches, fourteen inches, or sixteen inches. Also, it is contemplated that since the size of the baton 10 is interchangeable, the color of the tubular housing of the tubular structure 12 can have interchangeable colors.

As mentioned and discussed hereinafter, the components of the baton 10 are made of industrial grade plastic vinyl, which is waterproof, and highly shock resistant, but extremely lightweight. With respect to the vinyl material used, it is well known that vinyl is resistant to moisture and humidity. In fact, vinyl is a very strong and durable plastic material, as well as being a very low cost material to produce. Additionally, vinyl can be manufactured in a variety of colors, both transparent and solid. And, because of environmental concerns, vinyl is one of the few plastic materials, which can easily be recycled making the baton 10 very environmentally friendly.

For description purposes, the hollow tubular structure 12 is defined with a rear tubular part 14 and a front tubular part 16. The rear tubular part 14 has a ribbed rubber grip 18 wrapped around the rear tubular part 14 for ease of handling the baton 10. The baton 10 at the front tubular part 16 is exposed showing the industrial grade plastic, which is shown as ribbed, but it can also be smooth depending on the use of the baton 10.

A gasket member 19 is positioned between the rear 14 and front 16 tubular parts. The gasket member 19 is better described as a stationary ring stop. The gasket member or stationary ring stop 19 defines a hollow compartment 21 in the rear tubular part 14 and includes a further function that will be more fully described with reference to FIG. 3. A product label area 22 is provided around a portion of the front tubular part 16, so as to abut the ribbed rubber grip 18 that covers much of the rear tubular part 14.

Positioned around the rear tubular part 14 of the baton 10 is a removable rear or end cap 20 that has a diameter that is slightly larger than that of the rear tubular part 14 and forms a slip fit type connection to the rear tubular part 14. This slip fit type connection permits the removable rear cap 20 to be positioned at the end of the baton 10 and abut the ribbed rubber grip 18 snuggly around the rear tubular part 14 to provide a comfortable handle or grasping member for a user of the baton 10. The removable rear cap 20 is made of the pliable plastic vinyl material. It is this pliable plastic vinyl material that permits the removable rear cap 20 to seal the rear tubular part 14 and further defines the hollow compartment 21. And, since the rear cap 20 is removable there is an easily accessible rear access into the hollow compartment 21 in the hollow tubular structure 12 of the baton 10, which will be described in more detail with reference to FIGS. 2 and 3.

The baton 10 further includes a push button 24 that is mounted on face 26 of the removable rear end cap 20. The push button 24 is aligned on a center axis of the hollow tubular structure 12 so as to be readily accessible to the user. The button 24 is for switching between a plurality of modes with the plurality of modes being an on/off mode, a strobe mode, and a mode to generate help or an SOS signal. The operation of the push button 24 will be described in more detail with reference to FIGS. 2 and 3.

With continuing reference to FIG. 1, a front or top cap 30 is shown. The front cap 30 is similar in shape to the removable rear cap 20 that being a round tubular shape, with the front cap 30 having a diameter slightly larger than the front tubular part 16. The front cap 30 is basically open on one end and is made of a pliable or flexible clear plastic vinyl material. The front tubular cap 30 snugly and securely fits to the front tubular part 16 of the hollow tubular structure 12 so as to be positioned away from the rear removable rear cap 20 with the gasket member or stationary ring stop 19 in between them in the hollow tubular structure 12 forming the baton 10. The front cap 30 is secured with a slip tight fitting similar to that described with reference to the removable rear cap 20. This permits the front cap 30 to be removable as well. Thus, forming a waterproof and secure fit and completing the baton 10.

Figure 2:
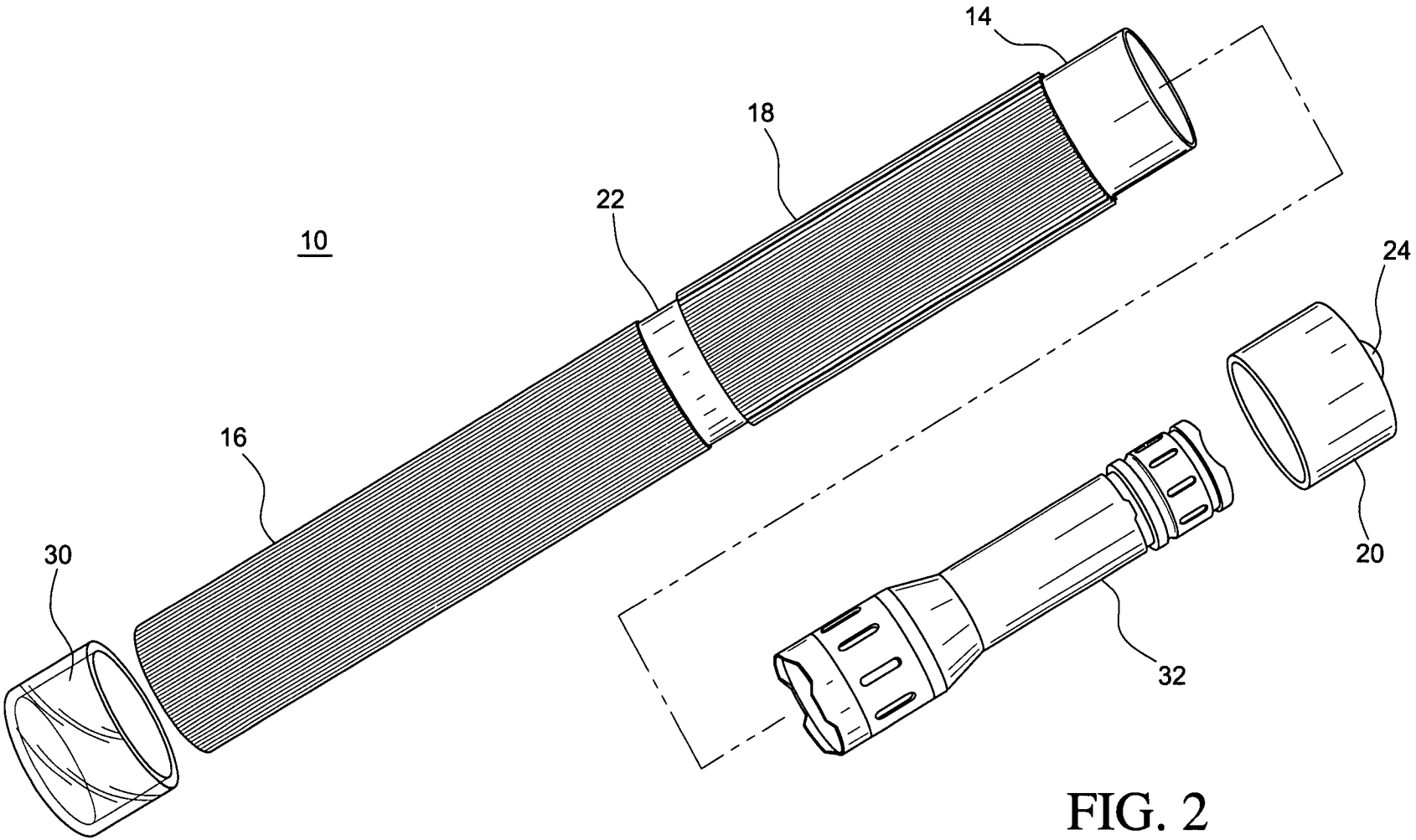
FIG. 2 illustrates an exploded view of the attention getting baton with the flashlight, in accordance with the present invention.

With reference now to FIG. 2, the figure illustrates an exploded view of the baton 10. At the front of the baton 10 is shown the transparent clear vinyl plastic top cap 30. As previously discussed, the top cap 30 is fixedly connected to the main body 16, which is made of industrial grade plastic vinyl and it is flexible. The main body 16 is, as is the entire baton 10, waterproof, shockproof, and lightweight. The removable rear cap 20 covers the rear tubular part 14 abutting the ribbed rubber grip 18. However, as shown in the exploded view of FIG. 2, a high intensity flashlight 32 is inserted into the hollow compartment 21 of the hollow tubular structure 12. The flashlight 32 positioned in the hollow compartment 21 provides a high intensity light beam through the clear flexible front vinyl plastic top cap 30. Of course, it is also contemplated that the flashlight 32 positioned in the hollow compartment 21 can provide covert signaling by using an infrared light source or an ultraviolet light source. Thus, because the flashlight 32 is positioned in the hollow compartment 21 and is removable, the light source is also interchangeable with other light sources and, in combination with the interchangeability of the hollow tubular structure 12, there are many different color light sources that can be produced.

Figure 3:
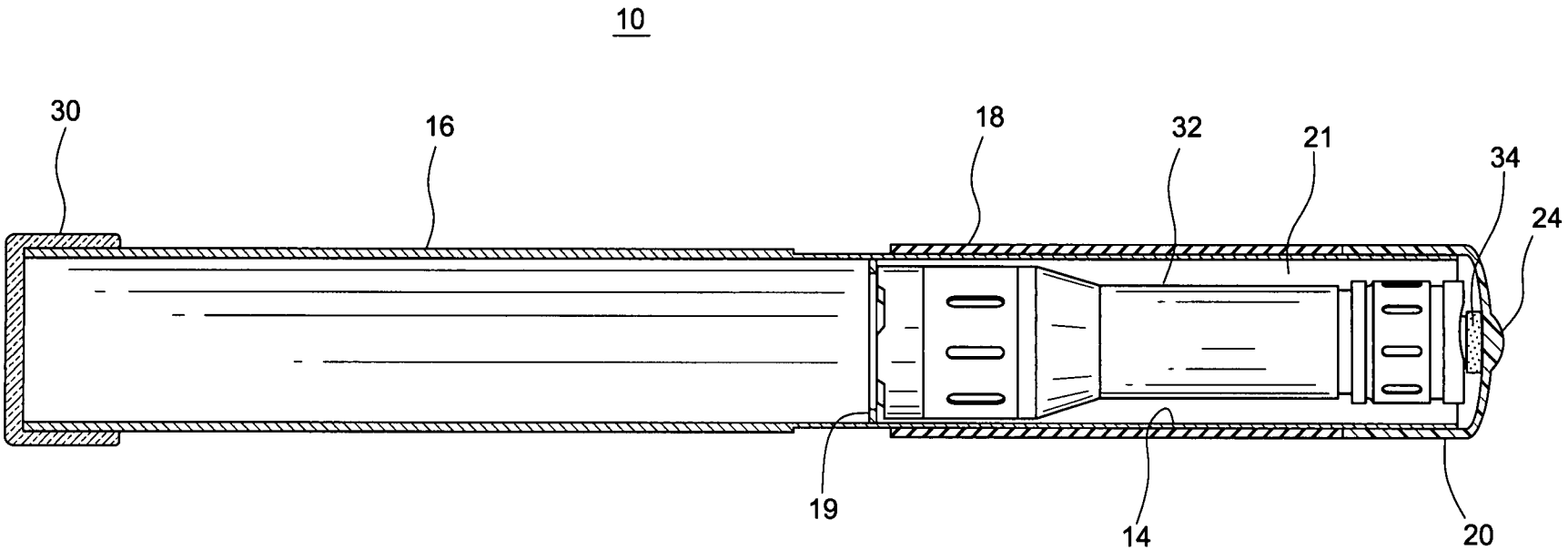
FIG. 3 illustrates a sectional view taken along lines 3-3 of FIG. 1 of the attention getting baton with the flashlight, in accordance with the present invention.

With reference to FIG. 3, which illustrates the sectional view taken along lines 3-3 of FIG. 1 of the attention getting baton 10 with the flashlight 32 positioned in the hollow compartment 21, in accordance with the present invention. When the flashlight 32 is inserted into the rear tubular part 14 and positioned in the hollow compartment 21, the stationary ring stop 19 abruptly stops the flashlight 32 from moving forward into the front tubular part 16. Additionally, just before the removable rear cap 20 is mounted onto the rear tubular part 14, a piece of foam 34 is inserted so the push button 24 is in physical communication with the flashlight 32. Now, by pressing the button 24, the foam 34 moves forward which will provide control to the flashlight 32. At this point, the flashlight 32 can be placed in the main different modes of operation, such as a first press is on or flash, a second press is a strobe, a third press is a help or SOS signal, and a final press turns the flashlight 32 off. It is further contemplated that the flashlight 32 can have an internal rechargeable battery as a power source. Thus, the baton 10 has applicability to fire scenes, traffic and crowd control, police operations, military procedures, search and rescue operations, event parking, or just any other personal use contemplated by the user.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

The invention claimed is:

1. An attention getting baton, comprising:

a hollow tubular structure being one piece and for communicating illumination through the baton;

a rear tubular part of the hollow tubular structure for providing a holding compartment and defining a handle member for the hollow tubular structure of the baton;

a ribbed rubber grip for wrapping around the rear tubular part and nearly covering the rear tubular part for easy handling of the baton when illumination being communicated through the hollow structure;

a front tubular part being exposed and formed of industrial grade plastic with ribbed groves for guiding illumination communicated from the rear tubular part;

a stationary ring stop positioned between the rear tubular part and the front tubular part in the hollow tubular structure for further defining the holding compartment by providing a stopping function from the rear tubular part to the front tubular part of the hollow tubular structure;

a tubular shaped removable rear cap having a diameter slightly larger than the rear tubular part for forming a slip fit type connection and abutting the ribbed rubber grip when positioned snuggly around the rear tubular part and for providing an easily accessible rear access into the holding compartment of the hollow tubular structure;

a button mounted to the tubular shaped removable rear cap, the button being aligned on a center axis of the hollow tubular structure and for switching the baton into a plurality of modes with the plurality of modes being an on/off mode, a strobe mode, and a mode to generate help or an SOS signal;

a removable tubular shaped front cap having a diameter slightly larger than the front tubular part and being made of a pliable clear plastic vinyl material for illuminating light communicated from the rear tubular part through the front tubular part of the hollow tubular structure, and for snugly and securely forming a slip tight fitting with the front tubular part of the hollow tubular structure so as to be positioned away from the rear removable rear cap with the stationary ring stop positioned in between in the hollow tubular structure; and a high intensity flashlight being inserted into the holding compartment of the rear tubular part of the hollow tubular structure for communicating a high intensity light beam illuminated through the front tubular part and the clear flexible vinyl plastic top cap.

2. The attention getting baton as claimed in claim 1, wherein the hollow tubular structure being made of industrial grade plastic vinyl and being waterproof, highly shock resistant, and extremely lightweight.

3. The attention getting baton as claimed in claim 1, wherein the button being a push button for controlling the high intensity flashlight.

4. The attention getting baton as claimed in claim 3, wherein the flashlight providing covert signaling by using an infrared light source.

5. The attention getting baton as claimed in claim 3, wherein the flashlight providing covert signaling by using an ultraviolet light source.

6. The attention getting baton as claimed in claim 1, wherein the flashlight being removable through the easily accessible rear access of the holding compartment in the hollow tubular structure.

7. The attention getting baton as claimed in claim 6, wherein the flashlight as a light source being interchangeable with other light sources.

8. The attention getting baton as claimed in claim 1, wherein the hollow tubular structure being interchangeable with other sizes and colors of hollow tubular structures for producing different color light sources.

9. The attention getting baton as claimed in claim 1, wherein the flashlight being inserted into the rear tubular part and the stationary ring stop abruptly stopping the flashlight from moving forward into the front tubular part.

10. The attention getting baton as claimed in claim 1, wherein a piece of foam being inserted between the button and the flashlight so as to be in physical communication with the flashlight.

11. The attention getting baton as claimed in claim 10, wherein the foam moving forward with the press of the button for providing control of the flashlight.

12. The attention getting baton as claimed in claim 11, wherein a first press of the button placing the flashlight in an on mode.

13. The attention getting baton as claimed in claim 11, wherein a second press of the button placing the flashlight in a strobe mode.

14. The attention getting baton as claimed in claim 11, wherein a third press of the button placing the flashlight in a help mode.

15. The attention getting baton as claimed in claim 11, wherein a final press of the button placing the flashlight in an off mode.

* * * * *